United States Patent [19]

Brambilla

[11] Patent Number: 4,631,898

[45] Date of Patent: Dec. 30, 1986

[54] PROCESS AND APPARATUS FOR CONTINUOUS WRAPPING OF PALLETIZED LOAD

[75] Inventor: Dario Brambilla, Novara, Italy

[73] Assignee: Dario Manuli S.p.A., Mosezzo, Italy

[21] Appl. No.: 671,968

[22] Filed: Nov. 16, 1984

[30] Foreign Application Priority Data

Nov. 16, 1983 [IT] Italy ..... 23740 A/83

[51] Int. Cl.[4] ..... B65B 13/10

[52] U.S. Cl. ..... 53/399; 53/210; 53/441; 53/588; 53/218; 180/169

[58] Field of Search ..... 53/210, 589, 588, 399, 53/559, 441, 218; 74/569; 180/169

[56] References Cited

U.S. PATENT DOCUMENTS

| | | | |
|---|---|---|---|
| 4,067,174 | 1/1978 | Goldstein | 53/210 X |
| 4,095,395 | 6/1978 | Goldstein | 53/198 |
| 4,209,961 | 7/1980 | Donnelley | 53/210 X |
| 4,369,614 | 1/1983 | Tetzner | 53/588 X |

FOREIGN PATENT DOCUMENTS

| | | | |
|---|---|---|---|
| 1487512 | 10/1977 | United Kingdom | 53/210 |

*Primary Examiner*—James F. Coan

*Attorney, Agent, or Firm*—Bacon & Thomas

[57] ABSTRACT

For continuously wrapping a palletized load, a self-propelling apparatus is provided, said apparatus being fitted with means for electric traction fed by batteries, said machine moving at a distance around the outer perimeter of a load.

The apparatus and with it the reel, from which the film unwinds to wrap the load, follows a path which alters in correspondence with the outer perimeter of the load to be wrapped. The outer perimeter of the load is detected by devices fitted inside a container for evaluating the preselected distance between the path to be followed by the apparatus and said outer perimeter of the load. Conveniently, said means are based on the emission of ultrasonic waves and receiving of their respective echos.

10 Claims, 9 Drawing Figures

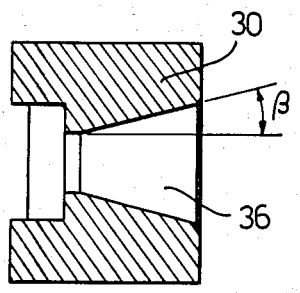
FIG.5
FIG.6
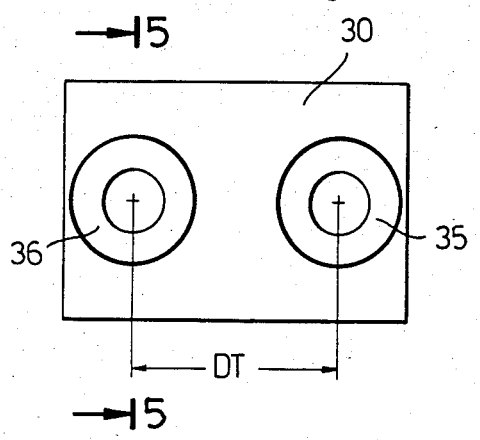
FIG.7
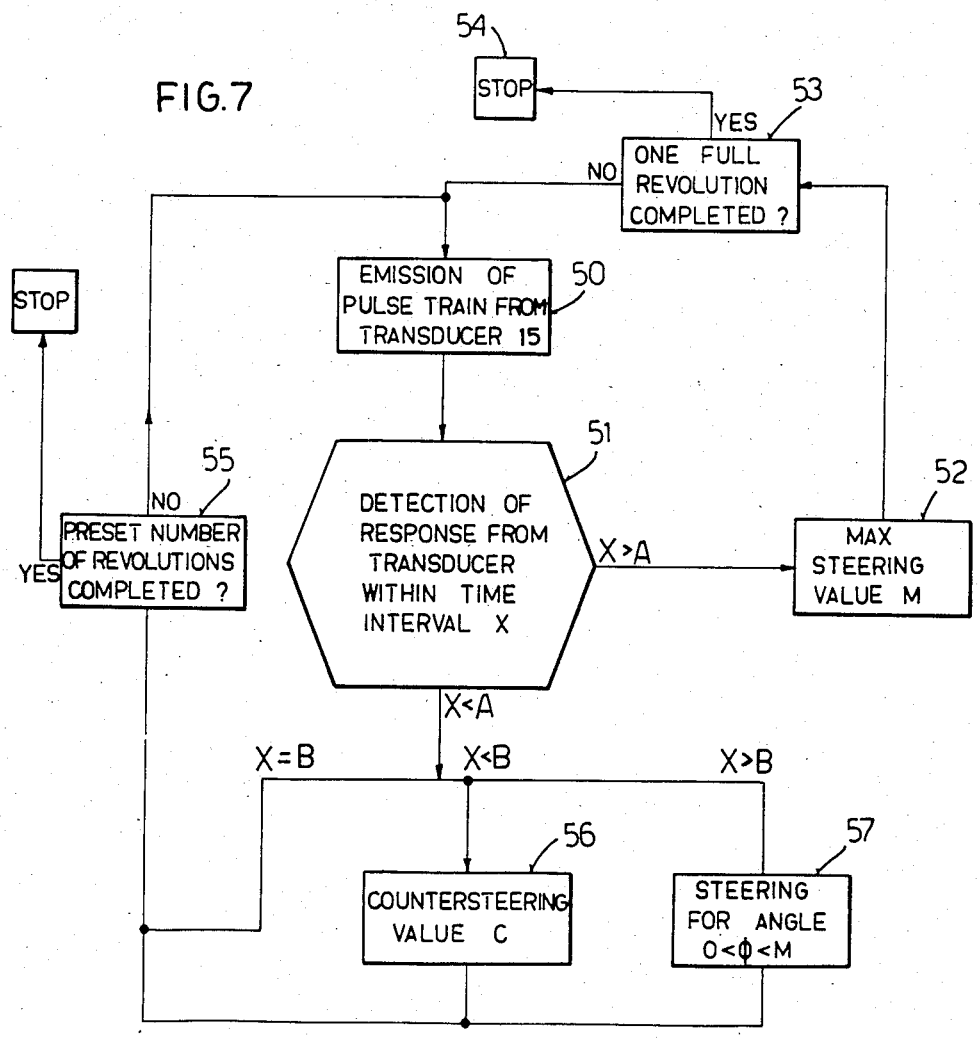

PROCESS AND APPARATUS FOR CONTINUOUS WRAPPING OF PALLETIZED LOAD

BACKGROUND OF THE INVENTION

1. Field of the Invention

This invention is directed to a process and an apparatus for continuous wrapping of palletized load with stretch-wrap film, which load is placed on a fixed base.

2. Description of Related Art

In the wrapping operation the powered machine conveys a reel of film around the load at some distance from it, so that the film is continuously wrapped around said palletized load or any bulky object, as it unwinds from the reel.

An apparatus for continuously wrapping a palletized load is previously known from European patent application No. 82 10 6492.0 by the same applicant. This apparatus comprises a carriage conveying a reel of stretch-wrap film, which carriage rests in turn on two sets of wheels with their axes converging at a point corresponding to the point at which a vertical axis through the palletized load to be wrapped intersects the floor. In its circular motion said carriage is guided by a steering unit of flat configuration, resting on the same floor on which the load lies, the steering unit being concentrical with the palletized load to be wrapped.

Although, in practice, this last mentioned machine has provided excellent results, it has however the disadvantage of requiring for the wrapping operation said carriage steering unit, with the resulting need to prearrange the palletized load in the center of said steering unit.

U.S. Pat. No. 4,095,395 describes a carriage for supporting a reel of stretch-wrap film. Said carriage comprises a means for steering it on a floor around the load to be wrapped, a feeler means projecting towards said load for contacting its surface, a means of support for the vehicle to allow free movement around the load and a unit for holding and wrapping the film around the load, as the vehicle freely travels along a path on the floor around said load for the required number of times. The path around the load is determined by the outer contour of the load.

With this vehicle, if the load has an irregular contour and especially any recess, the contact feeler may become stuck in said recess causing the vehicle to stop or, in any case, is more likely to break. This is also the case with platforms of irregular shape.

SUMMARY OF THE INVENTION

The object of the present invention is to provide a process for wrapping a palletized load without the need to follow the same fixed path, but with said path being determined each time by remote detection of load contour.

Another object is to provide an apparatus which can wrap a palletized load without following a preset path, but by matching said apparatus movements to the load contour detected with a remote sensing device.

These objects are achieved providing that the load contour is detected through evaluation of the time interval between emission of a pulse train, with preset duration and frequency, and reception of the response or echo reflected from the surface of the load to be wrapped. Optimum and/or maximum values are envisaged for this response time interval which depends on the frequency of the emitted waves, vehicle speed and optimum distance required between load and vehicle. In particular, steering signals are sent according to the response times in order to correct as quickly as possible the vehicle trajectory so that it always remains at the distance required. The machine for carrying out said process is provided with at least one pulse train emitter and at least one pulse train receiver. These transducers send the signals detected to a processor which controls the steerage-actuating means by comparing the time interval detected and the preset, optimum and maximum time interval on the basis of prearranged tables or algorithms.

BRIEF DESCRIPTION OF THE DRAWING

An exemplary embodiment of the invention is shown in the accompanying drawings, in which:

FIG. 5 shows a sectional view of the internal configuration of the support for the transducers which make up the remote sensing device according to the invention;

FIG. 6 is a side view of the transducer support in Fig. 5;

FIG. 7 is a block diagram of the control device which elaborates the signals picked up by the transducers and sends the necessary signals to the steerage-actuating devices and/or to the stop device;

DESCRIPTION OF THE PREFERRED EMBODIMENT

Figure 2:
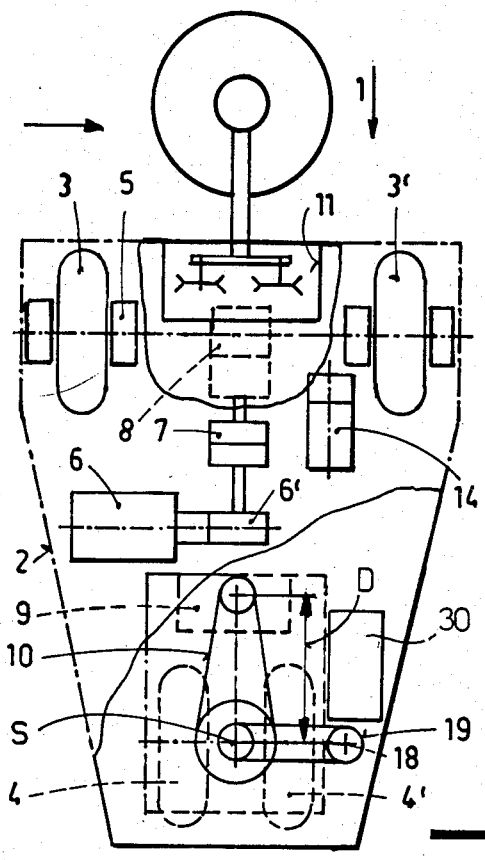
FIG. 2 is a schematic top-plan view of the machine.

Referring to the invention, the apparatus 1 (FIG. 2) comprises a wheeled base 2 lying at the rear on two drive wheels 3, 3' fitted coaxially one to the other, whereas the front of said base 2 rests on a pair of steering wheels 4, 4' which rotate relative to their vertical axle S.

The driving wheels 3, 3' are fitted parallel to the rear side of base 2 and are rotatable housed on bearings 5. Wheels 3, 3' are driven by a motive unit 6 with reduction gear 6', between which a universal joint 7 and differential 8 are disposed.

On the under surface of said wheeled base 2 is mounted a low inertia type servomotor 9 with reduction gear (not shown in drawings), said servomotor 9 serving to provide the steering movement for the pair of front wheels 4, 4'.

The servomotor 9 is mounted at an adjustable distance D from the vertical steering axle S of the front wheels, so that a yielding transmission means 10 can be placed in between for transmitting power from the servomotor to steering wheels 4, 4'.

Figure 3:
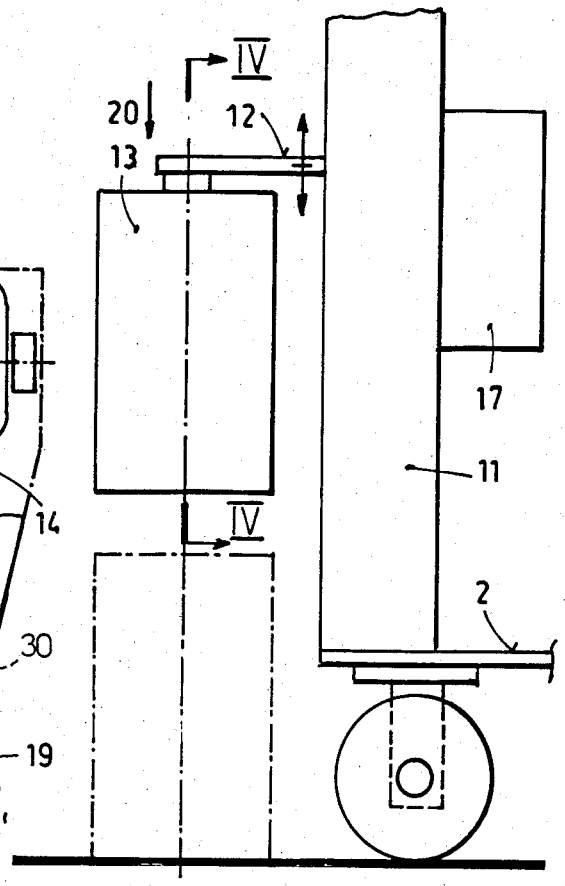
FIG. 3 is a schematic segmentary side view of the rear part of the machine with column, along which the unwinding reel moves vertically.

At the rear of the vehicle, a column 11 (FIG. 3) is mounted on base 2 vertical to it, said column being a vertical guide for a support 12 carrying a reel 13 of stretch-wrap film 13'. The alternating up and down movement of reel 13, synchronised with the forward movement of the vehicle, is controlled by a motor and reduction gear unit 14 (shown schematically in FIG. 2), reversible motion being used.

The extent of said vertical travel is determined by microswitches fitted on the column, but not shown.

On said wheeled base 2 (FIGS. 1 and 2) two transducers are also fitted to a support 30 at some distance apart, one being a transmitter and the other a receiver. They will be described in detail hereinafter.

A linear type potentiometer 18 (FIG. 2) is fitted near the axle S for steering wheels 4, 4' in order to evaluate at any moment the steering excursion. Said potentiometer 18 is connected to said axle by a belt or chain 19.

Figure 4:
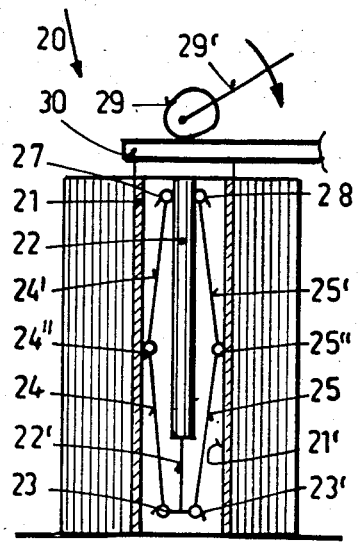
FIG. 4 is a vertical sectional view along a plane through IV—IV of FIG. 3.

To facilitate fitting of the film reel, which weighs about 25 kg onto its support 12 a device 20 (FIGS. 3 and 4) is provided which can be displaced along the above-said column 11. Said device 20 is for holding the reel in place. This is done by sliding it down into the tube 21 on which the stretch-wrap film 13' is wound and blocking it until all the film has been unwound.

The device 20 (FIG. 4) comprises a series of levers which, from a common point of articulation, press in opposite directions against the inner wall of the reel tube, thereby blocking it in place.

The device 20 comprises a hollow shaft 22, inside of which a guided rod 22' moves, its lower end 23 being some distance from the lower end of the said hollow shaft. This said lower end 23 forms the point of extreme lower articulation for at least two pairs of levers 24, 24' and 25, 25', articulated at 24'' and 25'' respectively, each said pair of levers being articulated at 27 and 28 respectively in the extreme upper part of the above-said hollow shaft 22.

By using, for example, a cam 29 fitted with lever 29' to press on base 30 of hollow shaft 22, said articulations 24'' and 25'' extend radially in opposite directions, causing a pressure to be exerted against the inner wall 21' of tube 21. This creates the friction needed for preventing the reel from both sliding off the device and rotating on it due to the considerable traction stress on the film, as the palletized load is being wrapped.

The angular rotation of lever 29' of cam 29 can be set by moving said lever manually or by a pneumatic or also hydraulic piston, and even by electric-powered means.

Conveniently, the source of electric power for the machine is made up of a series of batteries, mounted at the top of said carriage.

Figure 1:
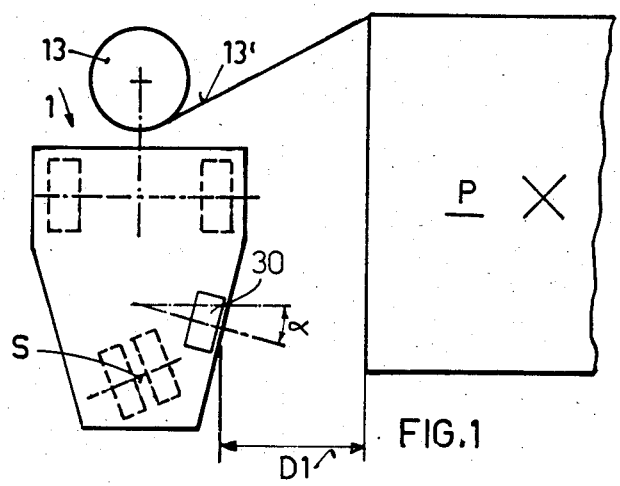
FIG. 1 is a schematic view showing how said invention operates.

The distance-detecting device consists of a pair of transducers of which one 15 is a wave transmitter and the other 16 a receiver. Both are fitted in a support or container 30 which is fixed at a predetermined height from the ground (between 20 cm and 60 cm) and may be inclined relative to the perpendicular of the vehicle's longitudinal axis (or parallel to the axis of the rear of drive wheels) at a predetermined angle $\alpha$ between 0° and 30° (FIG. 1).

It is preferable that said waves, emitted and received by the transducers after being reflected from the load surface, have a frequency comprised between 10 KHz and 60 KHz. However, they may have a higher frequency and be light waves. Detection of the reflected light wave and subsequent operations are based on the same process.

Said transducers are housed in cavities 35 and 36 which are slightly conical in shape so as to convey the emitted or received wave trains. The conical angle $\beta$ is between 10° and 20° (FIG. 5). The transducers are arranged in support 30 at a predetermined distance DT (FIG. 6), this distance depending on the wave frequency and vehicle speed.

The output signals from emitter 15 and input signals to receiver 16 are sent to an electronic control device which evaluates the preselected distance D1 (FIG. 1) between said transducers 15 and 16 and the object P. Then activating signals are sent to the means for actuating the driving wheels, causing them to rotate clockwise or anticlockwise at a predetermined angle, so that the vehicle is placed at the preset distance.

During automatic operation cycle, the vehicle is supposed to move around the load the required number of times, while the reel support device 20 is raised the predetermined amount for the wrapping to be carried out as required.

Distance D1 is maintained by adjusting the steering on the basis of the time measured between emission of ultrasonic waves from a ceramic transducer and the reception of their echo.

In fact, by measuring the time between emission of the ultrasonic waves and the return of their echo, it is possible to determine the distance between two objects and compare it with a prviously memorized value. The result obtained from the comparison cause the system controlling the steering means to move the vehicle closer to or further away from the object.

The use of a measuring system based on the velocity of sound (or wave) propagation in air gives considerably more precise results than previously known systems in other fields, which use infrared rays.

Figure 8:
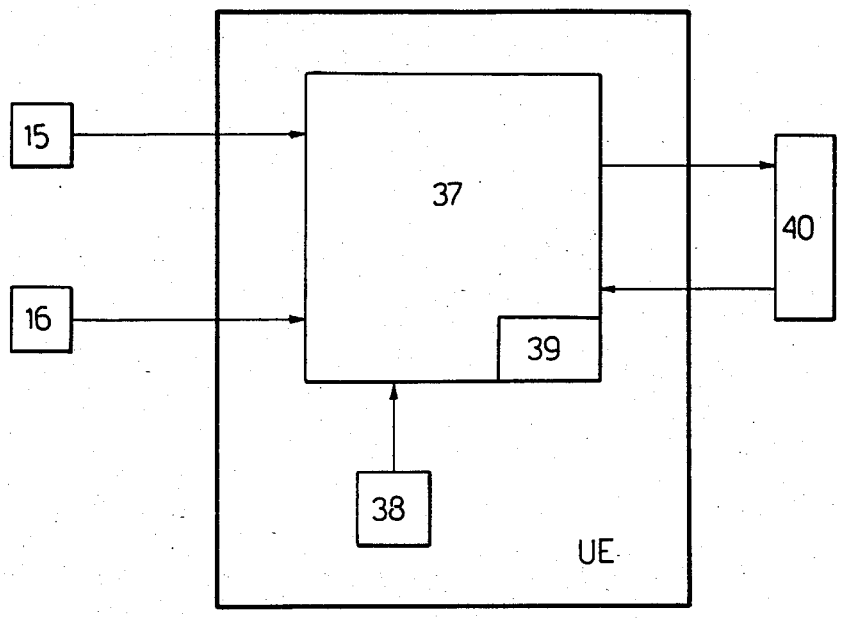
FIG. 8 shows a simplified diagram of the electronic control circuit in remote detection device according to the invention.

The control and processing equipment UE, as represented in FIG. 8, includes among other things a measuring and comparison device 37 using memorized values or values calculated on the basis of an algorithm and fed by a suitable oscillator 38. This device sends signals to operate the actuator 40 for the steering and counter-steering respectively, according to the time interval between emission of the wave train and reception of the echo or, in any case, within a preset time interval.

FIG. 7 shows a block diagram for the automatic process of the unit in FIG. 8 at first the vehicle is placed at a prefixed distance to complete a cycle in an anticlockwise direction.

In the first stage (50) a pulse train lasting a few milliseconds is sent by transducer 15. The comparison-making device waits for the echo signal, which is detected by receiver 16, and measures the time X between emission of pulse train and reception of echo (stage or step 51). If no echo is received within a predetermined time interval A, ($X>A$), a signal is sent to turn the steering anticlockwise to a predetermined maximum angle M (step 52). Then a new pulse train is sent and time X measured. If $X>A$ is still the case, the steering is turned anticlockwise to the maximum until a counter 39 indicates that a number N of steering turns have completed a full revolution (where $N.M \geqq 360°$) and sends a stop signal to the vehicle (steps 53 and 54).

If a response echo arrives in a time interval $X<A$, the comparison-making device checks whether the time X is greater, equal to or smaller than a prefixed optimum time interval B, said optimum time interval B being determined by the wave frequency, vehicle speed and prefixed optimum distance of vehicle from the load.

$X=B$ signifies that the vehicle is at the optimum distance and the load contour is flat in the part surveyed. Therefore, when it has been verified that other revolutions around the load (step 55) are still necessary, initial step 50 is again performed.

X<B signifies that the vehicle is too close to the load and a countersteering signal is sent (in this case in the clockwise direction) at a predetermined angle C (step 56). Afterwards steps 55 and 50 are performed.

If B<X<A the command is given to steer (clockwise) at an angle $\phi$ ($0<\phi<M$). Said angle $\phi$ may be obtained from a previously memorized table or from a function, for example a linear time function. Afterwards step 50 is performed. This cycle is repeated the number of times needed to wrap the load.

Of course, the duration of the wave train sent by transducer 15 is much shorter than interval B.

Figure 9:
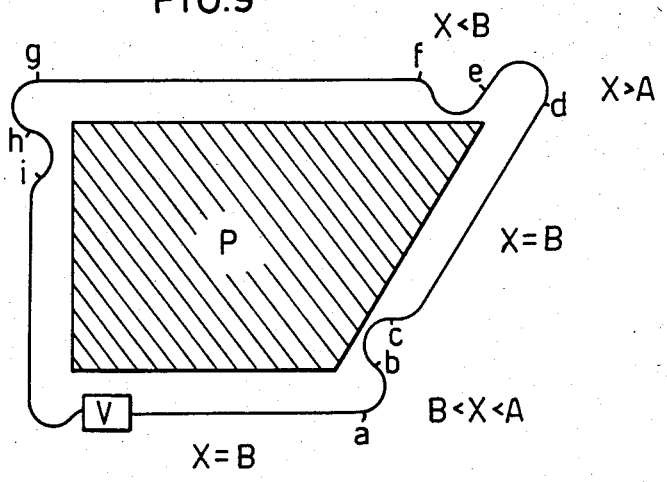
FIG. 9 is an exemplary plan view of a vehicle moving in a closed loop around a load, according to the invention.

FIG. 9 shows an example of a complete cycle by vehicle V around load P. Up to point a, the time measured X=B, for section a–b, B X A,
for section b–c, X B,
for c–d, X=B,
for d–e, X A,
for e–f, X B,
for f–g, X=B,
for g–h, X A,
for h–i, X=B.

By way of example, not binding, the variability ranges are given below for the present values in the case of a vehicle with transducers emitting ultrasonic waves at 40 KHz and moving at a speed of about 1.5 m/sec, at a distance from the load of approx. 140 cm.

A is between 10 and 30 msec.
B is between 6 and 15 msec.
C is between 2° and 50°
M is between 30° and 50°.

It is clear that by this process of comparison the vehicle is maintained at a predetermined distance from the load, the wrapping operation being carried out as required.

What I claim is:

1. A process for continuous wrapping of palletized load with stretch-wrap film, in which a vehicle, provided with a steering means and moving freely around a load in a predetermined direction, follows a path determined by the contour of the load, said contour being detected by a distance-detecting device which sends signals to a processor which emits command signals to the vehicle steering means, wherein at least one wave train is sent for a preset time interval and the response echo is awaited for a maximum time interval; if no response is received within the maximum time interval, a command is sent to the steering means to steer at a predetermined angle in a set direction and another pulse train is sent; if, on the other hand, the response echo arrives within the maximum time interval, said response is evaluated according to an optimum time and a signal is sent to steer in the set direction whenever the response time is greater than the optimum time or in the opposite direction whenever the response time is less than the optimum time, another pulse train is sent until the vehicle has completed a preset number of revolutions around the load.

2. A process as in claim 1, wherein if no response is received within the maximum time interval, a command is sent to the steering means to steer at the maximum angle foreseen in the set direction, up to a maximum number of times.

3. A process as in claim 1, wherein if the time interval for the response is greater than the optimum time, the vehicle is steered at an angle which is a linear function of the reply time.

4. An apparatus for continuous wrapping of palletized load with stretch-wrap film, the load being placed on a fixed base, said apparatus being driven by a motor and supported by two pairs of drive wheels and having a support which moves cyclically up and down and from which the film unwinds to wrap the load, as said apparatus moves at a distance around the outer perimeter of said load, being provided with a steering device for steering a fluctuating path relative to the outer periphery of the load, a distance-detecting device which sends signals to the steering device, said distance detecting device comprising an emitter of waves at a predetermined requency, a receiver of the reflected waves and a comparison-making device which sends signals to the means for actuating the steering device, according to the comparison of the actual time, measured between emission of the waves and reception of the response, with preset values.

5. An apparatus as in claim 4, wherein the waves emitted from the emitter are maintained within a frequency range of about 40 KHz.

6. An apparatus as in claim 4, wherein said emitter and receiver are arranged inside a container into cavities which are slightly conical in order to better convey the emitted or received waves.

7. An apparatus as in claim 6, wherein said container is placed at a height above the ground between 20 cm and 60 cm.

8. An apparatus as in claim 6, said container is inclined relative to the perpendicular of the apparatus longitudinal axis.

9. An apparatus as in claim 4, wherein the steering path is continuously controlled by a linear potentiometer; front steering wheels and a steering axle connected to the base; said potentiometer being coupled to the steering axle of the front steering wheels.

10. An apparatus as in claim 9, wehrein the steering wheels are driven by a low inertia type servomotor and the latter is controlled by an electronic unit which is part of the apparatus.

* * * * *